US006804974B1

(12) United States Patent
Voglewede et al.

(10) Patent No.: US 6,804,974 B1
(45) Date of Patent: Oct. 19, 2004

(54) REFRIGERATOR UNIT WITH LIGHTED ICE DISPENSER CAVITY

(75) Inventors: Ronald L. Voglewede, St. Joseph, MI (US); Mark E. Glotzbach, Fowler, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 14 days.

(21) Appl. No.: 10/460,563

(22) Filed: Jun. 12, 2003

(51) Int. Cl.[7] ..... F25D 25/00
(52) U.S. Cl. ..... 62/264; 362/92; 362/276
(58) Field of Search ..... 62/188, 264, 389, 62/390, 440, 441; 362/92, 96, 276

(56) References Cited

U.S. PATENT DOCUMENTS

| | | | | | |
|---|---|---|---|---|---|
| 3,798,923 | A | * | 3/1974 | Pink et al. | 62/266 |
| 3,874,559 | A | * | 4/1975 | Pink | 222/146.6 |
| 3,942,334 | A | * | 3/1976 | Pink | 62/266 |
| 4,646,528 | A | * | 3/1987 | Marcade et al. | 62/127 |
| 4,689,965 | A | * | 9/1987 | Janke et al. | 62/155 |
| 4,807,086 | A | * | 2/1989 | Chambliss | 361/212 |
| 4,851,662 | A | | 7/1989 | Ott et al. | 250/214 AL |
| 4,912,942 | A | * | 4/1990 | Katterhenry et al. | 62/338 |
| 5,033,273 | A | * | 7/1991 | Buchser et al. | 62/344 |
| 5,490,547 | A | * | 2/1996 | Abadi et al. | 141/359 |
| 5,551,598 | A | * | 9/1996 | Cutsinger | 222/52 |
| 5,787,724 | A | * | 8/1998 | Pohl et al. | 62/389 |
| 6,055,823 | A | * | 5/2000 | Baker et al. | 62/265 |
| 6,597,126 | B1 | * | 7/2003 | Parra | 315/209 R |

FOREIGN PATENT DOCUMENTS

JP 09235345 A * 9/1997

OTHER PUBLICATIONS

Pub. No.: US 2003/0110784 A1, Pub. Date Jun. 19, 2003, Applicant Lee. Filed on Dec. 17, 2002.*

* cited by examiner

*Primary Examiner*—William E. Tapolcai
*Assistant Examiner*—Mohammad M. Ali
(74) *Attorney, Agent, or Firm*—Robert O. Rice; John F. Colligan; Stephen Krefman

(57) ABSTRACT

An illuminating device for an appliance is provided. The illuminating device is in communication with a sensor that measures an environmental condition. During operation of the appliance, the illuminating device is continually operated at a light level greater than or equal to a minimum light level. Preferably, the light level of the illuminating device is adjusted based upon measuring or detecting an environmental condition.

21 Claims, 4 Drawing Sheets

REFRIGERATOR UNIT WITH LIGHTED ICE DISPENSER CAVITY

BACKGROUND OF THE INVENTION

The present invention relates to appliances with illuminating devices, and more particularly, to an illuminating device for use with a dispenser unit of a refrigeration apparatus and including a sensor that measures or detects an environmental condition.

Manufacturers of refrigerators have offered, as a feature of their product, a dispenser unit mounted to the exterior of the refrigerator door. Such a dispenser unit is usually combined with an illuminating device, such as an incandescent light bulb, located within the dispenser unit to illuminate a portion of the dispenser unit. Generally, the illuminating device operates once a user places an object, such as a glass, within or near the dispenser unit.

Illustratively, U.S. Pat. No. 4,851,662 to Ott et al., discloses a refrigerator having an light bulb in a through-the-door dispenser. A control circuit having a photosensitive switch is connected with the light bulb. The control circuit applies a half wave rectified line voltage to the light bulb when there is little or no ambient light, thereby dimly lighting the light bulb at night time. In response to the dispenser being activated, the photosensitive switch is shunted, and the control circuit applies a line voltage to the light bulb.

A common problem, associated with illuminating devices in appliances, such as the ones described above, is the power requirements of these devices. Many illuminating devices typically run off of line voltage, such as 120 volts of alternating current. Accordingly, it would be an improvement to provide an illuminating device for an appliance that has reduced power requirements. Another disadvantage of the prior art illuminating devices in appliances is that they often time use light bulbs with heated filaments to generate light. The heated filaments may cause undesirable heating in certain areas within or surrounding the appliance. Moreover, some prior art illuminating devices do not adjust to changing light conditions, and rather, are either set to illuminate at a predetermined level of intensity. Additionally, many prior art illuminating devices do not take into account environmental condition surrounding them and other factors, such as, whether a person is actually in the room or not, before or during operation.

Accordingly, it would be an improvement to provide an illuminating device for an appliance that generates less heat than the devices in the prior art. Moreover, many types of illuminating devices in appliances wear out and need to be replaced. Accordingly, it would be an improvement to provide an illuminating device for an appliance that will not wear out during the lifetime of the appliance. Additionally, it would be an improvement to provide an illuminating device for an appliance that occupies less space than the devices in the prior art. It would also be an improvement to provide an illuminating device for an appliance that adjusts to changing environmental conditions, such as the light, motion, or the temperature in the ambient surroundings. Moreover, it would be an improvement to provide an illuminating device for an appliance that includes a sensor, such as a motion detector, that could detect the presence of a person, and adjust the operation of the illuminating device accordingly to save additional energy.

SUMMARY OF THE INVENTION

According to one aspect of the present invention, a refrigerator including a door for gaining access to a refrigerated compartment is provided. The refrigerator includes a dispenser unit, an illuminating device, and a sensor. The dispenser unit is mounted in the door. The illuminating device is mounted within the dispenser unit and the sensor is in communication with the illuminating device. When activated, the illuminating device illuminates at a light level greater than or equal to a minimum light level during operation of the refrigerator. According to another aspect of the present invention, the illuminating device comprises a light-emitting diode.

According to another aspect of the present invention, an appliance is provided. The appliance includes a sensor, an illuminating device, and an electronics unit. The sensor measures an amount of ambient light surrounding the appliance. The illuminating device emits light at a certain light level. The electronics unit is in communication with the sensor and the illuminating device. The electronics unit adjusts the light level of the illuminating device based upon the amount of ambient light surrounding the appliance.

According to another aspect of the present invention, a method for operating an illuminating device in a dispenser unit of a refrigerator is provided. The method includes continually illuminating the illuminating device at a light level greater than or equal to a minimum light level during operation of the refrigerator.

DETAILED DESCRIPTION OF THE PREFERRED EMBODIMENT

The present invention relates to an illuminating device for a dispenser mounted in a refrigerator door. The illuminating device is in communication with a sensor that measures or detects an environmental condition, as described below. During operation of the refrigerator, the illuminating device is operated at a light level greater than or equal to a minimum light level. While the invention finds particular utility in a refrigeration appliance where an illuminating device may be provided in the dispenser of the appliance, the invention is not limited to such use and can be used in any type of appliance, such as a coffee machine, a dishwasher, a conventional oven, a range, a microwave oven, a vending machine, a commercial appliance, a telephone, and other such devices. However, to provide a specific example of the invention, the invention is disclosed as used in connection with a refrigeration appliance.

Figure 1:
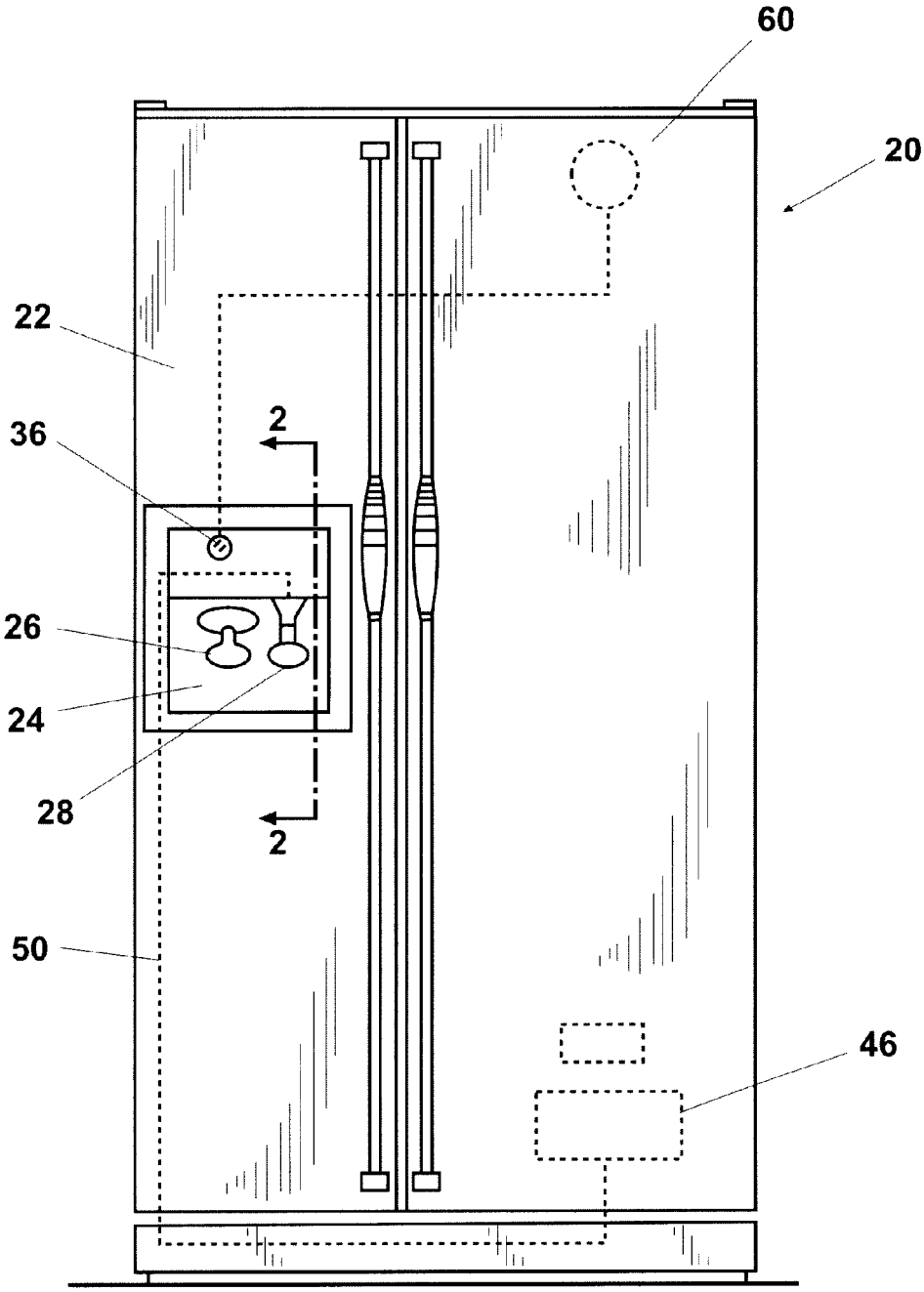
FIG. 1 is a front view of a refrigerator having a dispenser unit incorporating the principles of the present invention.

Referring to FIG. 1, a refrigerator 20 is provided with a door 22 for gaining access to a below freezing compartment (not shown). Located centrally on the outer face of the door 22 is an outwardly opening dispenser unit 24 in which are mounted an ice dispenser 26 and a water dispenser 28.

Figure 2:
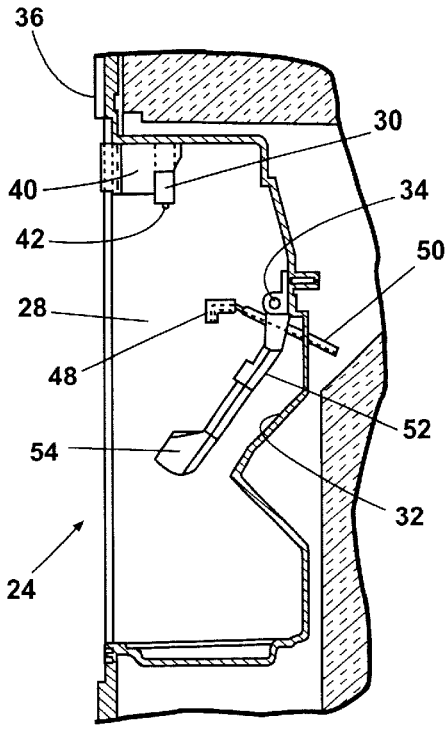
FIG. 2 is a side view of a dispenser unit with which the present invention can be utilized, taken generally along the line II—II of FIG. 1.

As shown in FIG. 2, illustrative purposes, is the water dispenser 28. The water dispenser 28 and the ice dispenser 26 function in similar ways, however, the water dispenser 28 dispenses water, while the ice dispenser 26 dispenses ice. The water dispenser 28 has a cradle shaped glass receiving portion 54 which is pivotally attached to a back surface 32 of the dispenser unit 24 by a pin 34. A torsion spring (not shown) associated with the pin 34 biases the glass receiving portion 54 to the position shown in FIG. 2. Thus, after the glass receiving portion 54 is rotated to the position shown in FIG. 3, it will subsequently return to the position shown in FIG. 2.

Figure 3:
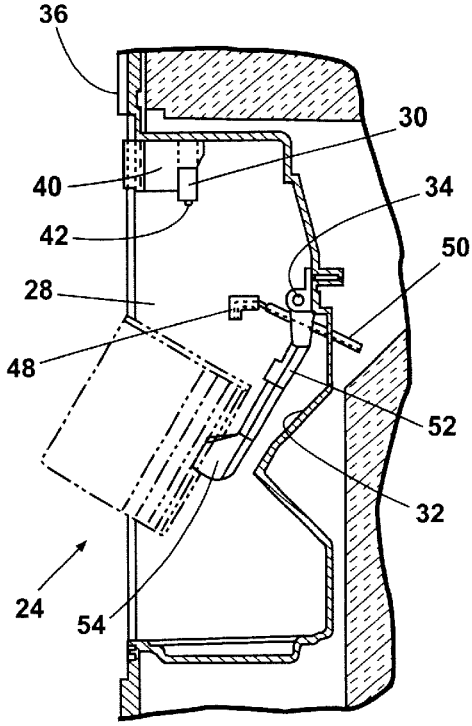
FIG. 3 is the same view as FIG. 2, but showing the water dispenser actuated by a drinking glass.

As the glass receiving portion 54 is rotated from a rested position, as shown in FIG. 2, to an active position, as shown in FIG. 3, a switch or sensor (not shown) is operated. Operation of the switch or sensor completes an electrical circuit between a source of power and a solenoid operated valve connected to a water supply or water reservoir 46. The water reservoir 46 is connected to a water spout 48 by an interconnecting tube or conduit 50. Thus, when the solenoid valve is opened, pressurizing reservoir 46, water is caused to be delivered to the water spout 48.

The glass receiving portion 54 is connected with the pin 34 through a lower extension 52. As illustrated in FIG. 3, the glass receiving portion 54 is configured to allow a drinking glass to be conveniently pressed against the glass receiving portion 54 and dispense water from the water spout 48, located above the glass receiving portion 54, into the glass. While the water dispenser 28 is described above in detail, the dispenser unit 24 may dispense a variety of items, such as ice, juice, or foods, and use a variety of dispensing techniques to do so. Additionally, the dispenser unit 24 may contain a variety of dispensing units, such as the ice dispenser 26 and the water dispenser 28. Preferably, each dispensing unit includes a switch or sensor (not shown) that is operated upon the performance of an act, such as the user inserting a glass into the dispenser unit 24.

An illuminating device 30 is mounted within the dispenser unit 24, as illustrated in FIG. 2. Preferably, the illuminating device 30 is positioned so that it may illuminate a specific portion of the dispenser unit 24. More preferably, the illuminating device 30 is positioned to illuminate an object within the dispenser unit 24, such as a glass, or glass-receiving portion 54. The illuminating device 30 includes any type of light source such as a light-emitting diode (LED), an organic light-emitting diode (OLED), a polymer light-emitting diode (PLED), an incandescent light source, a laser light source, a xenon light source, a halogen light source, an electroluminescence panel, or any type of solid state illumination device. Preferably, the illuminating device 30 includes a light-emitting diode 42, since a light-emitting diode generally consumes less energy than some other types of light sources.

A sensor 36 is in communication with the illuminating device 30. The sensor 36 detects or measures an environmental condition, such as, the amount of ambient light; motion; temperature; sound; moisture; voltage; and any other condition that may be detected with a sensor. In one embodiment, the sensor 36 is a light sensor 37 that measures or determines the amount of ambient light surrounding the refrigerator 20. Preferably, the light sensor 37 includes a phototransistor, however the light sensor 37 may include any device that can be used to measure an amount of light. As used herein, the level of light or light level of a light source, such as the ambient light surrounding the refrigerator 20 or the illuminating device 30, is the amount of light, typically measured in lumens, that the light source emits. For example, the light level of the illuminating device 30, i.e. the illuminating device's light level, is the amount of light emitted by the illuminating device. Additionally, the ambient light level, is the amount of light emitted by the ambient light surrounding the refrigerator 20. Preferably, the sensor 36 is located adjacent to or near the dispenser unit 30. More preferably, the sensor 36 is located on the exterior of the refrigerator 20 so that the sensor 36 may measure or detect environment conditions surrounding the refrigerator 20. In one embodiment, the sensor 36 is positioned behind a panel, which, at least in front of the sensor 36, is made of a translucent material such as clear plastic so that ambient light surrounding the refrigerator 20 is incident on the sensor 36.

In one embodiment, the sensor 36 detects motion. The sensitivity of the sensor 36 to detecting motion can be adjusted to detect for various types of motions or movements. Preferably, in this embodiment, the sensor 36 can be adjusted to detect the movements of a person.

In one embodiment, the dispenser unit 24 includes the sensor 36, as illustrated in FIG. 1. Preferably, the sensor 36 is a light sensor 37 that measures an amount of ambient light surrounding the dispenser unit 24 and generates a signal in response to the amount of ambient light, also referred to herein as the ambient light level.

Figure 4:
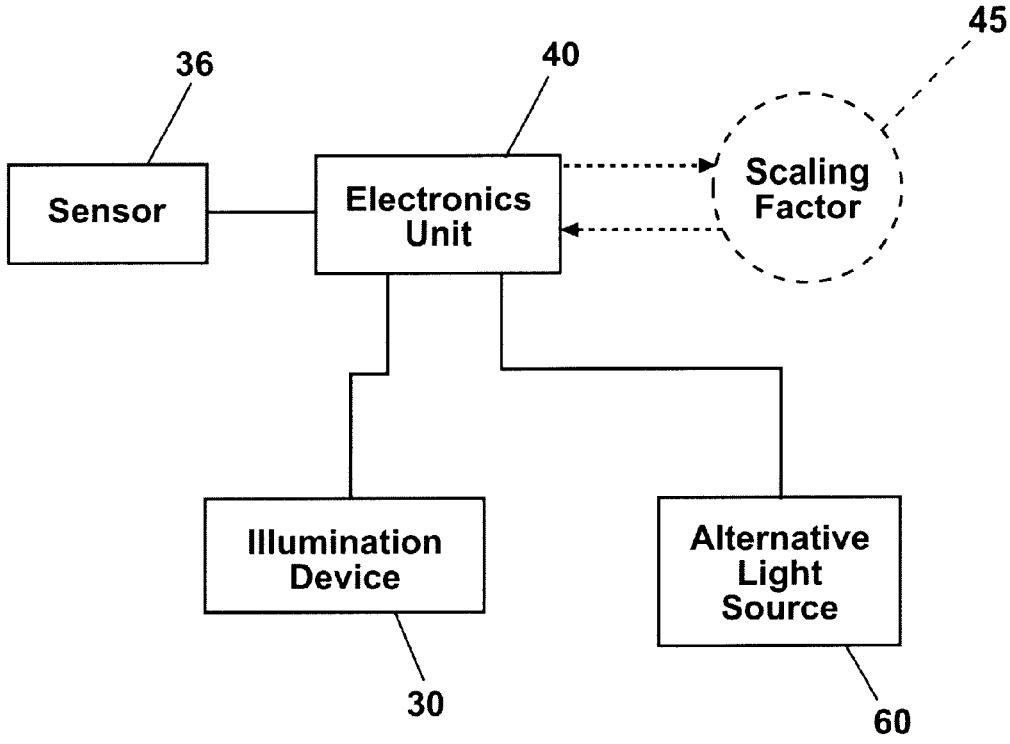
FIG. 4 is a schematic illustration of electrical architecture of one embodiment of the present invention.

As illustrated schematically in FIG. 4, the sensor 36 is preferably connected with an electronics unit 40 that receives the signal from the sensor 36. The electronics unit 40, which is also in communication with the illuminating device 30, then determines and adjusts, based upon the readings for the sensor 36, the light level of the illuminating device 30.

In this embodiment, the sensor may be a phototransistor having an analog output, that is digitally sampled by the electronics unit 40. The digital sample can be multiplied by a scaling factor 45 in the electronics unit and this value used for a PWM timer whose output can be used to drive a transistor that in turn would drive the LEDs, so that they are PWM dimmed. The use of a scaling factor avoids the need for a look-up table for providing variable light output.

In one embodiment, the electronics unit 40 is in communication with an alternative light source 60. The electronics unit 40, which is also in communication with the illuminating device 30, then determines and adjusts, based upon the readings for the sensor 36, the light level of the an alternative light source 60. The alternative light source 60 can include any type of light source, such as, a light-emitting diode (LED), an organic light-emitting diode (OLED), a polymer light-emitting diode (PLED), an incandescent light source, a laser light source, a xenon light source, a halogen light source, an electroluminescence panel, or any type of solid state illumination device. In one embodiment, the alternative light source 60 is located inside an appliance, such as the refrigerator 20. By allowing the electronics unit 40 to determine and adjust, based upon the readings for the sensor 36, the light level of the an alternative light source 60, alternative light sources 60 can be controlled in a variety of ways and in conjunction with the illuminating device 30.

Figure 5:
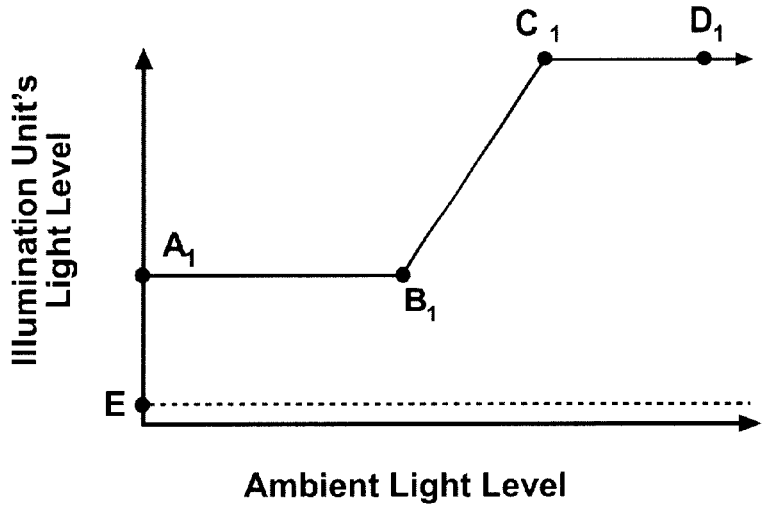
FIG. 5 is a graphical illustration comparing the illuminating device's light level to the ambient light level, in accordance with one embodiment.

In one embodiment, during operation of the refrigerator 20, the illuminating device 30 is continually illuminated at a light level greater than or equal to a minimum light level E, which is of some intensity, during operation of the refrigerator 20, as illustrated in FIGS. 4 and 5. Thus, unlike the prior art, in this embodiment the illuminating device 30 is always operating at some minimum light level E unless the illuminating device 30 is broken or worn, or the refrigerator 20 is not operating. By being continually illuminated at or above some minimum light level E, the illuminating device 30 is able to continuously illuminate a specific portion of the refrigerator 20, and more specifically, the dispenser unit 24.

Preferably, the light level of the illuminating device 30 may be varied based upon the environmental condition detected. For example, in one embodiment, the light level of the illuminating device 30 is decreased when the amount of ambient light surrounding the refrigerator 20 is decreased, as illustrated in FIG. 5. In this embodiment, the light level of the illuminating device 30 is proportional to the amount of ambient light such that the illuminating device 30 is de-energized from a peak light level at point $C_1$ to an initial light level at point $B_1$ for some reduced amount of ambient light. In one embodiment, the light level of the illuminating device 30 also stays at an initial light level even if the amount of ambient light is increased, as seen between points $A_1$ and $B_1$, of FIG. 5, or as seen between points $A_2$ and $B_2$ of FIG. 6. In one embodiment, the light level of the illuminating device 30 also stays at a peak light level even if the amount of ambient light is increased beyond some level, as seen between points $C_1$ and $D_1$ of FIG. 5. In one embodiment the light level of the illuminating device 30 is increased when the amount of ambient light surrounding the refrigerator 20 is increased, as illustrated in FIG. 5. In this embodiment, the light level of the illuminating device 30 is proportional to the amount of ambient light such that the illuminating device 30 is energized from an initial light level at point $B_1$ to a peak light level at point $C_1$ at full ambient light.

Figure 6:
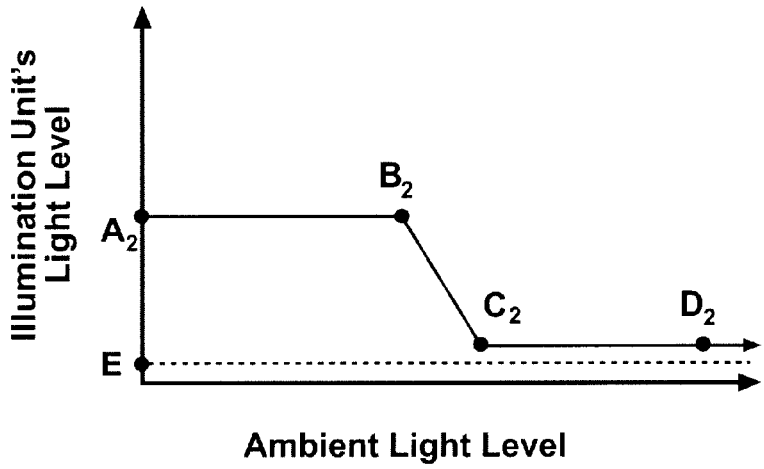
FIG. 6 is a graphical illustration comparing the illuminating device's light level to the ambient light level, in accordance with one embodiment.

In one embodiment, the light level of the illuminating device 30 is increased when the amount of ambient light surrounding the refrigerator 20 is decreased, as illustrated in FIG. 6. In this embodiment, the light level of the illuminating device 30 is inversely proportional to the amount of ambient light such that the illuminating device 30 is energized from a reduced light level at point $C_2$ to an initial light level at point $B_2$ at a reduced level of ambient light. In one embodiment, the light level of the illuminating device 30 is decreased when the amount of ambient light surrounding the refrigerator 20 is increased, as illustrated in FIG. 6. In this embodiment, the light level of the illuminating device 30 is inversely proportional to the amount of ambient light such that the illuminating device 30 is de-energized from an initial light level at point $B_2$ to a reduced light level at point $C_2$ at full ambient light. In one embodiment, the light level of the illuminating device 30 also stays at a reduced light level even if the amount of ambient light is increased beyond some level, as seen between points $C_2$ and $D_2$ of FIG. 6. By varying the light level of the illuminating device 30 based upon the amount of ambient light, the illuminating device 30 may illuminate a specific portion of the refrigerator 20 based upon the level of ambient light.

In one embodiment, the light level of the illuminating device 30 is varied based upon the amount of motion detected by the sensor 36. For example, of the sensor detects a certain amount of motion, above a minimum threshold, then the illuminating device may activated. In one embodiment, the light level of the illuminating device 30 is increased when an amount of motion is detected by the sensor 36.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A refrigerator including a door for gaining access to a refrigerated compartment, the refrigerator comprising:

a dispenser unit mounted in the door; and an illuminating device mounted within the dispenser unit; and a sensor in communication with the illuminating device, the illuminating device being continually illuminated at a light level greater than or equal to a minimum light level during operation of the refrigerator and the light level being adjustable to any level between an off condition and a fully bright condition.

2. The refrigerator of claim 1, wherein the illuminating device comprises a light-emitting diode.

3. The refrigerator of claim 1, wherein the light level of the illuminating device is decreased when the amount of ambient light surrounding the refrigerator is decreased.

4. The refrigerator of claim 1, wherein the light level of the illuminating device is increased when the amount of ambient light surrounding the refrigerator is decreased.

5. The refrigerator of claim 1, wherein the light level of the illuminating device is decreased when the amount of ambient light surrounding the refrigerator is increased.

6. The refrigerator of claim 1, wherein the light level of the illuminating device is increased when the amount of ambient light surrounding the refrigerator is increased.

7. The refrigerator of claim 1, wherein the light level of the illuminating device is adjusted when motion is detected by the sensor.

8. The appliance of claim 1, further comprising an alternative light source in communication with the sensor configured to measure an environmental condition, the light level from the alternative light source being adjustable based on the measured environmental condition.

9. An appliance comprising:

a sensor that measures an environmental condition surrounding the appliance;

an illuminating device that continually emits light at a minimum light level during operation of the appliance; and an electronics unit in communication with the sensor and the illuminating device, the electronics unit configured to adjust the light level of the illuminating device based upon the environmental condition, wherein the electronics unit includes a scaling factor and multiplies the scaling factor with an output of the sensor to provide the adjustment of the light level.

10. The appliance of claim 9, wherein the illuminating device comprises a light-emitting diode.

11. The appliance of claim 9, wherein the electronics unit decreases the light level of the illuminating device when the amount of ambient light surrounding the appliance is decreased.

12. The dispenser unit of claim 9, wherein the electronics unit increases the light level of the illuminating device when the amount of ambient light surrounding the appliance is decreased.

13. The dispenser unit of claim 9, wherein the electronics unit decreases the light level of the illuminating device when the amount of ambient light surrounding the appliance is increased.

14. The dispenser unit of claim 9, wherein the electronics unit increases the light level of the illuminating device when the amount of ambient light surrounding the appliance is increased.

15. The dispenser unit of claim 9, wherein the appliance includes a dispenser unit that dispenses at least one of ice and water.

16. An appliance comprising:

a sensor that measures an environmental condition surrounding the appliance, wherein the environmental condition is one of motion, temperature, sound, and moisture;

an illuminating device that emits light during operation of the appliance; and an electronics unit in communication with the sensor and the illuminating device, wherein the electronics unit adjusts the light level of the illuminating device based upon the environmental condition.

17. The appliance of claim 16, wherein the electronics unit includes a scaling factor and multiplies the scaling factor with an output of the sensor to provide the adjustment of the light level.

18. A refrigerator including a door for gaining access to a refrigerated compartment, the refrigerator comprising:

a dispenser unit mounted in the door; and an illuminating device mounted within the dispenser unit;

an alternative light source mounted in the refrigerator; and a sensor configured to measure an environmental condition and in communication with the illuminating device and the alternative light source, the light level from the illuminating device and the alternative light source being adjustable based on the measured environmental condition.

19. The refrigerator of claim 18, wherein the illuminating device and the alternative light source are adjustable to any level between an off condition and a fully bright condition.

20. The refrigerator of claim 18, wherein the illuminating device is continually illuminated at a light level greater than or equal to a minimum light level during operation of the refrigerator.

21. The refrigerator of claim 18, wherein the light level of the illuminating device is adjusted when motion is detected by the sensor.

* * * * *